United States Patent [19]

Reen

[11] 4,032,336

[45] June 28, 1977

[54] SINTERED LIQUID PHASE STAINLESS STEEL

[75] Inventor: Orville Reen, Lower Burrell, Pa.

[73] Assignee: Allegheny Ludlum Industries, Inc., Pittsburgh, Pa.

[22] Filed: June 25, 1976

[21] Appl. No.: 699,826

Related U.S. Application Data

[62] Division of Ser. No. 542,986, Jan. 22, 1975, Pat. No. 3,980,444.

[52] U.S. Cl. ..... 75/224; 75/200; 75/214

[51] Int. Cl.[2] ..... B22F 1/00

[58] Field of Search ..... 75/200, 224, 214

[56] References Cited

UNITED STATES PATENTS

| | | | |
|---|---|---|---|
| 2,238,382 | 4/1941 | Boegchold | 75/200 |
| 3,859,085 | 1/1975 | Kimura et al. | 75/200 |

OTHER PUBLICATIONS

Jones, *Fundamental Principles of Powder Metallurgy*, 1960, p. 224.

Eremenko, V. N. et al., *Liquid Phase Sintering*, Consultants Bureau, New York, 1970.

Bain et al., *Alloying Elements in Steel*, 2nd Ed. 1966, pp. 243–244.

McGannon, *The Making, Shaping and Treating of Steel*, 8th Ed., 1964, p. 1112.

Benesovsky et al., *Proceedings of the Inter. Symposium on Reactive Solids*, [Abstracted from Goetzel, *Treatise on Powder Met.* vol. IV, part 1, p. 593, No. 5414, 1963].

Benesovsky et al., II Neuve Hutte 2(9), [Abstracted from Goetzel, *Treatise on Powd. Met.*, vol. IV part I, p. 594, No. 5420].

*Primary Examiner*—Richard E. Schafer

*Attorney, Agent, or Firm*—Vincent G. Gioia; Robert F. Dropkin

[57] ABSTRACT

A sintered stainless steel having an overall density of at least 95% of full density and a morphology comprised of regions of sintered austenitic stainless steel and regions of solidified liquid phase. Moreover, a sintered steel which is made by: pressing and sintering prealloyed powder consisting essentially of, by weight, up to 0.05% carbon, 22 to 26% chromium, 10 to 24% nickel, 2.7 to 5% molybdenum, 0.1 to 1% boron, up to 2.0% manganese, up to 2.0% silicon, balance iron and residuals.

6 Claims, 2 Drawing Figures

SINTERED LIQUID PHASE STAINLESS STEEL

This is a division of application Ser. No. 542,986, filed

Jan. 22, 1975 now U.S. Pat. No. 3,980,444.

The present invention relates to sintered stainless steel having excellent resistance to corrosive attack by the chloride ion, to pre-alloyed stainless steel powder for use in making the sintered steel, and to the method of making it.

In order to improve both corrosion resistance and mechanical properties, manufacturers of sintered stainless steel parts often employ various methods to increase the density, and hence decrease the porosity, of the parts being made. Increasing of sintering temperatures is one of their methods for attaining such a result. Higher sintering temperatures are, however, disadvantageous insofar as they increase power requirements and necessitate the use of expensive furnaces capable of maintaining and withstanding the higher temperatures. It is therefore desirable to increase density without increasing sintering temperatures.

Another method for increasing the density of sintered stainless steel involves the use of powder containing boron. A solid liquid phase forms during sintering, and a steel of high density is produced. Unfortunately, however, austenitic steel powders such as AISI Type 316L with boron, have produced sintered parts displaying poor resistance to corrosive attack by the chloride ion, despite their high density. In studying this phenomenon, I have observed that boron depletes the chromium and molybdenum content of the remainder of the austenitic alloy in forming the heretofore referred to solidified liquid phase. As a result, the sintered part's resistance to the chloride ion is severely impaired.

The present invention provides a highly dense sintered stainless steel having good corrosion resistance to the chloride ion. The alloy contains boron to increase its density, and chromium and molybdenum in sufficient amounts to offset any depletion attributable to boron and its accompanying solidified liquid phase. The use of boron in a stainless steel powder is disclosed by W. D. Jones on page 224 of his book entitled, "Fundamental Principles of Powder Metallurgy." The book was published in London by Edward Arnold Ltd., 1960.

It is accordingly an object of the present invention to provide sintered stainless steel having excellent resistance to corrosive attack by the chloride ion.

Figure 1:
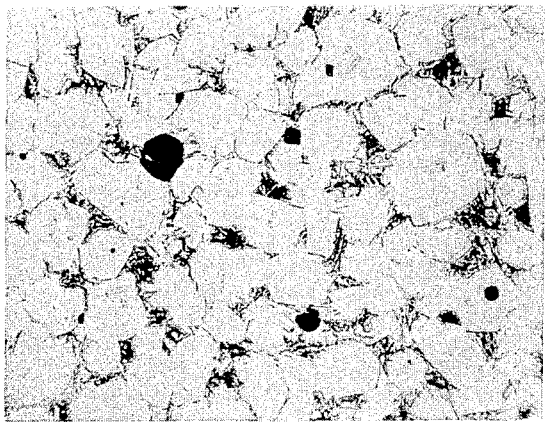
Figure 2:
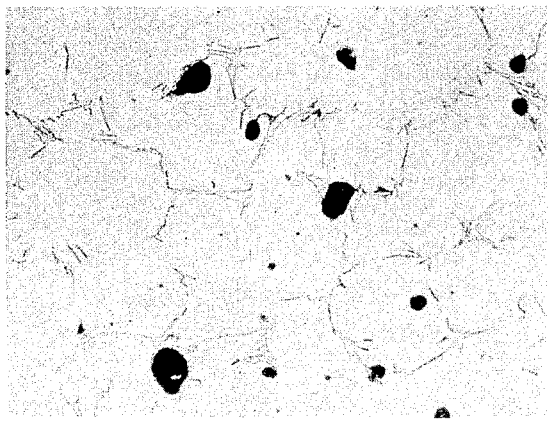

The foregoing and other objects of the invention will be best understood from the following description, reference being had to the accompanying figures wherein:

FIG. 1 is a photomicrograph at 250X of a stainless steel containing 22.44% chromium, 13.27% nickel, 3.01% molybdenum and 0.27% boron; and FIG. 2 is a photomicrograph at 250X of a stainless steel containing 22.34% chromium, 17.94% nickel, 3.01% molybdenum and 0.26% boron.

The sintered stainless steel of the present invention has an overall composition consisting essentially of, by weight, up to 0.05% carbon, 22 to 26% chromium, 10 to 24% nickel, 2.7 to 5% molybdenum, 0.1 to 1% boron, up to 2.0% manganese, up to 2.0% silicon, balance iron and residuals; and an overall density of at least 95% of full density. As the composition and the density of the steel vary thereacross, the term overall is used in describing them. During sintering boron combines with other constituents to form a liquid (eutectic) phase. Hence the sintered steel contains regions of solidified liquid phase in addition to regions of sintered austenitic stainless steel, voids and non-metallic inclusions.

The solidified liquid phase is responsible for the high density of the sintered stainless steel of this invention. As a general rule, the density is in excess of 98% of full density. Densities in excess of 99% of full density are, however, within the realm of the invention. To obtain these high densities at reasonable sintering temperatures, a minimum of 8% liquid phase is generally required. When more than 25% liquid phase is present, some difficulty in maintaining shape may be encountered. Boron contents between 0.2 and 0.5% generally provide the desired amount of liquid phase.

Chromium, molybdenum and nickel render the steel resistant to corrosive attack by the chloride ion. As formation of the solidified liquid phase depletes the chromium and molybdenum content of the remainder of the steel, high levels of these elements are required. Preferred minimum chromium and molybdenum levels are respectively 22.3% and 3%. Nickel is generally present in amounts of from 13 to 18%. Levels in excess of 16% are often preferred as nickel renders the powder more compressible.

The sintered stainless steel of the present invention is made by: (1) pressing pre-alloyed stainless steel powder consisting essentially of, by weight, up to 0.05% carbon, 22 to 26% chromium, 10 to 24% nickel, 2.7 to 5% molybdenum, 0.1 to 1% boron, up to 2.0% manganese, up to 2.0% silicon, balance iron and residuals, into a green compact; and (2) sintering the green compact in a substantially non-oxidizing atmosphere at a temperature of from 2250° to 2375° F. Sintering is preferably carried out at a temperature at or less than 2350° F, and generally within the temperature range of from 2275° to 2350° F. Typical non-oxidizing atmospheres are hydrogen and those involving reduced pressures.

Alternative processing for producing the sintered stainless steel of the present invention includes the steps of: (1) pressing the pre-alloyed powder into a green compact; (2) sintering the green compact at a temperature below the liquid phase forming temperature; (3) re-pressing; (4) and re-sintering at a temperature at or above the liquid phase forming temperature. This alternative processing decreases the change in dimension occurring during final sintering, and as a result thereof makes it easier to stay within dimensional requirements. The initial sintering is generally carried out at a temperature less than 2250° F. Final sintering is at a temperature of from 2250° to 2375° F.

The following examples are illustrative of several aspects of the invention.

EXAMPLE I

Several castings were prepared to determine minimum chromium and molybdenum levels for the subject invention. As discussed hereinabove, higher than normal chromium and molybdenum levels are required, as boron in forming the solidified liquid phase, depletes the chromium and molybdenum content of portions of the steel. The chemistry of the castings appears hereinbelow in Table I. The castings had a simulated metallurgical structure of liquid-phase sintered alloys.

TABLE I

| Casting | Composition (wt. percent) Cr | Ni | Mo | B | Fe |
|---|---|---|---|---|---|
| A | 17.69 | 13.48 | 1.84 | 0.25 | Bal. |
| B | 19.24 | 14.88 | 2.09 | 0.25 | Bal. |
| C | 18.07 | 14.89 | 2.50 | 0.25 | Bal. |
| D | 21.50 | 17.27 | 2.50 | 0.25 | Bal. |
| E | 22.46 | 18.22 | 2.90 | 0.25 | Bal. |
| F | 22.14 | 19.10 | 3.52 | 0.25 | Bal. |
| G | 21.88 | 18.82 | 4.02 | 0.25 | Bal. |
| H | 21.62 | 20.53 | 4.52 | 0.25 | Bal. |
| I | 21.48 | 20.89 | 4.78 | 0.25 | Bal. |

The castings were cross sectioned and metallographically polished. One-half of each casting was subjected to a 5% neutral salt spray test and the other half to an anodic polarization test in a 3% salt solution adjusted to pH5. Anodic polarization tests determine the breakthrough potential in various corrosive media. In such tests, the higher breakthrough voltage indicates greater corrosion resistance. The results of the tests appear hereinbelow in Table II.

TABLE II

| Casting | 5% NaCl Spray (Hours to Rust) | Breakthrough Potential 3% NaCl Solution Adjusted to pH5 (volts/S.C.E.) |
|---|---|---|
| A | 18 | — |
| B | 468+ | — |
| C | 18 | 0.12 |
| D | 90 | 0.25 |
| E | 18 | 0.81 |
| F | 468+ | 0.90 |
| G | 468+ | 0.97 |
| H | 468+ | 0.95 |
| I | 468+ | 0.82 |

From the tests, and in particular the breakthrough potential test, it was determined that the pre-alloyed powder of the subject invention should have a minimum chromium content of 22% and a minimum molybdenum content of 2.7%. Preferred minimum chromium and molybdenum contents were respectively determined to be 22.3 and 3%.

EXAMPLE II.

Two lots (A + B) of pre-alloyed powder having the chemistry set forth hereinbelow in Table III were prepared.

TABLE III

| Lot | Composition (wt. percent) C | Cr | Ni | Mo | B | Mn | Si | Fe |
|---|---|---|---|---|---|---|---|---|
| A | 0.008 | 22.44 | 13.27 | 3.01 | 0.27 | 0.065 | 0.90 | Bal. |
| B | 0.007 | 22.34 | 17.94 | 3.01 | 0.26 | 0.061 | 0.99 | Bal. |

Each of the powder lots was screened to obtain discrete mesh fractions and reblended to produce lots of powder with the following particle size distribution:

| | Wt. Percent |
|---|---|
| −100/+200 mesh: | 30 |
| −200/+325 mesh: | 30 |
| −325 mesh: | 40 |

The average particle diameter of the −325 fraction, as measured by the Fisher Sub-Sieve Sizer, was:

Lot A — 19.0 micromillimeters

Lot B — 20.2 micromillimeters

Using die wall lubricant, 10 gram compacts of each powder were pressed at 45 tons per square inch using double action pressing. The compacts were sintered at various temperatures within the range of from 2260° to 2350° F in a reduced pressure of $5 \times 10^{-2}$ Torr. Sintering times, temperatures and densities for the compacts appears hereinbelow in Table IV.

TABLE IV

| *Compact | Green Density g/cu cm | Sintering Temp. (° F) | Sintering Time (Minutes) | Sintering Density (g/cu cm) | % of Cast Density |
|---|---|---|---|---|---|
| A-1 | 72.1 | 2260 | 60 | 6.82 | 86.8 |
| A-2 | 72.1 | 2275 | 15 | 7.80 | 99.2 |
| A-3 | 72.1 | 2300 | 15 | 7.79 | 99.1 |
| A-4 | 72.1 | 2300 | 30 | 7.82 | 99.5 |
| A-5 | 72.1 | 2300 | 60 | 7.77 | 98.9 |
| B-1 | 77.2 | 2300 | 15 | 7.04 | 90.1 |
| B-2 | 77.1 | 2300 | 30 | 7.37 | 94.4 |
| B-3 | 77.1 | 2300 | 60 | 7.41 | 94.9 |
| B-4 | 77.1 | 2300 | 150 | 7.68 | 98.3 |
| B-5 | 77.1 | 2325 | 15 | 7.39 | 94.6 |
| B-6 | 77.1 | 2325 | 30 | 7.53 | 96.4 |
| B-7 | 77.1 | 2325 | 60 | 7.76 | 99.4 |
| B-8 | 77.1 | 2350 | 15 | 7.74 | 99.1 |

*A Compacts from Lot A
B Compacts from Lot B

A and B compacts having densities of about 99% of their cast densities were exposed to a 5% neutral salt spray. After 608 hours exposure, the compacts exhibited no signs of corrosion.

Additional A and B compacts having densities of about 99% of their cast densities were corrosion tested in a dip-dry apparatus. The samples were tested by alternately immersing them in a 5% salt solution for 10 minutes and drying them for 50 minutes. After 528 hours, no sign of rust was apparent.

A metallographic examination of the compacts showed regions of austenitic structure surrounded by solidified liquid (eutectic) phase. Well rounded pores, obviously not interconnected, were also observable.

FIG. 1 which is a photomicrograph of Compact A-3 displays a light austenitic matrix, a mottled solidified liquid phase and a dark round phase of oxides and/or pores. The percentage of solidified liquid phase is estimated to be 20%.

FIG. 2 which is a photomicrograph of Compact B-5 is similar to FIG. 1 with the exception that the solidified liquid phase does not appear as a mottled phase. The percentage of solidified liquid phase is estimated to be 10%.

A microprobe study was made of densely sintered compacts from each lot of powder. The semi-quantitative analysis of the compacts appears hereinbelow in Table V.

TABLE V

| | | Composition (wt. percent) Cr | Ni | Mo |
|---|---|---|---|---|
| Lot A | Matrix | 21 | 15 | 2.6 |
| Lot A | Eutectic Phase | 29 | 6 | 5.6 |
| Lot B | Matrix | 22 | 19 | 2.6 |
| Lot B | Eutectic Phase | 39 | 6 | 6.2 |

The analysis reported in Table V indicates that the eutectic phase depletes the matrix of chromium and molybdenum. to the pre-alloyed powder of the subject invention must have at least 22% chromium and 2.7% molybdenum if the matrix of the sintered alloy is going ro have excellent corrosion resistance to corrosive attack by the chloride ion.

EXAMPLE III

To demonstrate the alternative processing of the subject invention, additional powder from Lots A and B was blended with 0.5% stearic acid powder and double action pressed into green compacts at a pressure of 45 tons per square inch. The green compacts were then sintered in dry, flowing hydrogen for 30 minutes at temperatures of from 2000° to 2300° F. After sintering the compacts were double action re-pressed at 45 tons per square inch using stearic acid die wall lubricant, and sintered in dry, flowing hydrogen for 30 minutes at 2300° F. The densities after initial sintering, re-pressing and final sintering appear hereinbelow in Table VI, along with their initial sintering temperature.

TABLE VI

| Compact | Initial Sintered Temperature (° F) | Initial Sintered Density (% of cast) | Re-Pressed Density (% of cast) | Final Sintered Density (% of cast) |
|---|---|---|---|---|
| A-6 | 2000 | 76.2 | 84.2 | 92.9 |
| A-7 | 2200 | 81.0 | 85.4 | 100.0 |
| A-8 | 2300 | 99.2 | — | 99.9 |
| B-9 | 2000 | 80.1 | — | 92.6 |
| B-10 | 2200 | 81.6 | 88.1 | 94.9 |
| B-11 | 2300 | 92.6 | 93.5 | 95.8 |

The data in Table VI clearly demonstrates the feasibility of the alternative processing of the subject invention. Re-pressing could prove to be highly beneficial in those instances which require stringent dimensional control.

It will be apparent to those skilled in the art that the novel principles of the invention disclosed herein in connection with specific examples thereof, will suggest various other modifications and applications of the same. It is accordingly desired that in construing the breadth of the appended claims they shall not be limited to the specific examples of the invention described herein.

I claim:

1. A method of making sintered stainless steel having an overall density of at least 98% of full density and a morphology comprised of regions of sintered austenitic stainless steel and regions of solidified liquid phase, which comprises the steps of: subjecting pre-alloyed stainless steel powder consisting essentially of, by weight, up to 0.05% carbon, 22 to 26% chromium, 10 to 24% nickel, 2.7 to 5% molybdenum, 0.1 to 1% boron, up to 2.0% manganese, up to 2.0% silicon, balance iron and residuals, to at least one pressing; and sintering said pressed compact in a substantially non-oxidizing atmosphere at a temperature of from 2250° to 2375° F.

2. A method according to claim 1, wherein said sintering temperature is from 2275° to 2350° F.

3. A method according to claim 1, wherein said pre-alloyed powder has from 22.3 to 26% chromium and from 3 to 5% molybdenum.

4. A method according to claim 1, wherein said pre-alloyed powder has from 0.2 to 0.5% boron.

5. A method according to claim 1, wherein said pre-alloyed powder has from 22.3 to 26% chromium, from 13 to 18% nickel, from 3 to 5% molybdenum and from 0.2 to 0.5% boron.

6. A method according to claim 1, wherein said pre-alloyed powder has at least 16% nickel.

* * * * *